US006644627B1

(12) United States Patent
Forrester

(10) Patent No.: US 6,644,627 B1
(45) Date of Patent: Nov. 11, 2003

(54) TOOL FOR REMOVING DECK BOARDS

(76) Inventor: Joseph Forrester, 4320 Clack Rd., Auburn, GA (US) 30011

( * ) Notice: Subject to any disclaimer, the term of this patent is extended or adjusted under 35 U.S.C. 154(b) by 0 days.

(21) Appl. No.: 10/202,856

(22) Filed: Jul. 26, 2002

(51) Int. Cl.[7] ..... B66F 3/00
(52) U.S. Cl. ..... 254/17; 254/131; 254/25
(58) Field of Search ..... 254/15, 17, 25, 254/131, 131.5, 134, DIG. 3; 294/57, 58, 167; 16/110 R, 114 R, 114 A, 115; 29/267

(56) References Cited

U.S. PATENT DOCUMENTS

| | | | | | |
|---|---|---|---|---|---|
| 1,309,734 | A | | 7/1919 | Hemfling, Sr. | |
| 1,343,862 | A | | 6/1920 | Williams | |
| 1,375,751 | A | | 4/1921 | Grannis | |
| 1,389,820 | A | | 9/1921 | Downey | |
| 1,455,019 | A | * | 5/1923 | Cameron | 254/131 |
| 1,567,025 | A | * | 12/1925 | Allison | 254/131 |
| 2,374,530 | A | | 4/1945 | Fiebke, Sr. | |
| 3,049,337 | A | | 8/1962 | Griggs | |
| 3,168,285 | A | | 2/1965 | Russac et al. | |
| 4,151,838 | A | * | 5/1979 | Crew | 128/20 |
| 4,183,503 | A | * | 1/1980 | Ward | 254/131 |
| 5,165,659 | A | | 11/1992 | L'Heureux | |
| 5,265,661 | A | * | 11/1993 | Tran | 157/1.3 |
| 5,447,289 | A | | 9/1995 | Callahan | |
| 6,488,266 | B2 | * | 12/2002 | Macor | 254/25 |

* cited by examiner

*Primary Examiner*—Joseph Hail
*Assistant Examiner*—Daniel Shanley
(74) *Attorney, Agent, or Firm*—Shoemaker and Mattare

(57) ABSTRACT

A tool for removing deck boards includes a base having a short shaft with a handle socket affixed thereto, and a pair of spaced prying arms connected to opposite ends of the shaft. The prying arms are spaced so they straddle a joist when the base member is placed on top of the joist. Each of the arms has a convex upper surface portion for engaging bottom surfaces of the boards, and the convex portion remains in contact with the center of the board as the board is pulled from the joist. The handle has a bend and may be rotated 180° with respect to the base member to achieve different effective handle angles.

6 Claims, 7 Drawing Sheets

TOOL FOR REMOVING DECK BOARDS

BACKGROUND OF THE INVENTION

This invention relates to hand tools and more specifically to tools designed for removing deck boards or the like from floor joists to which they are attached.

Deck floors are commonly comprised of a series of boards, commonly called deck boards, laid side-by-side atop and running perpendicular to the floor joists of the deck. The deck boards usually are attached to the joist by nails which have been driven through the boards into the joists. From time to time it is necessary to replace the deck boards, which deteriorate.

Deck boards are usually removed by using some form of tool known as a pry bar or wrecking bar. Such tools facilitate the removal of deck boards by acting as long levers which multiply the force applied to the tool handle; however, there are a number of disadvantages inherent in the use of such tools. One of the most apparent disadvantages is that, for each board to be removed, the pry bar must be driven between the deck board and the joist using a hammer or other tool in order to begin the prying operation. Often this is required at most of the points where the deck board is nailed to the joist. This method of separating the two attached components is both difficult and time-consuming and most often results in a considerable amount of damage to both the joist and the deck board being removed.

Another disadvantage of using convention pry bar tools is that, while configured to provide the mechanical advantage of a lever, they frequently do not provide enough lift (displacement) in the prying operation to fully clear the nails from their attachment to the joist. Thus there is a need for a tool that will simplify and expedite the removal of deck boards while minimizing damage to both the deck boards and the joists to which they are attached.

SUMMARY OF THE INVENTION

An object of the invention is to eliminate the disadvantages noted above by providing a swift and convenient means of removing deck boards while causing little or no damage to the deck board to the joist. Other advantages will be apparent from the following description.

BRIEF DESCRIPTION OF THE DRAWINGS

In the accompanying drawings.

DESCRIPTION OF THE PREFERRED EMBODIMENT

Figure 1:
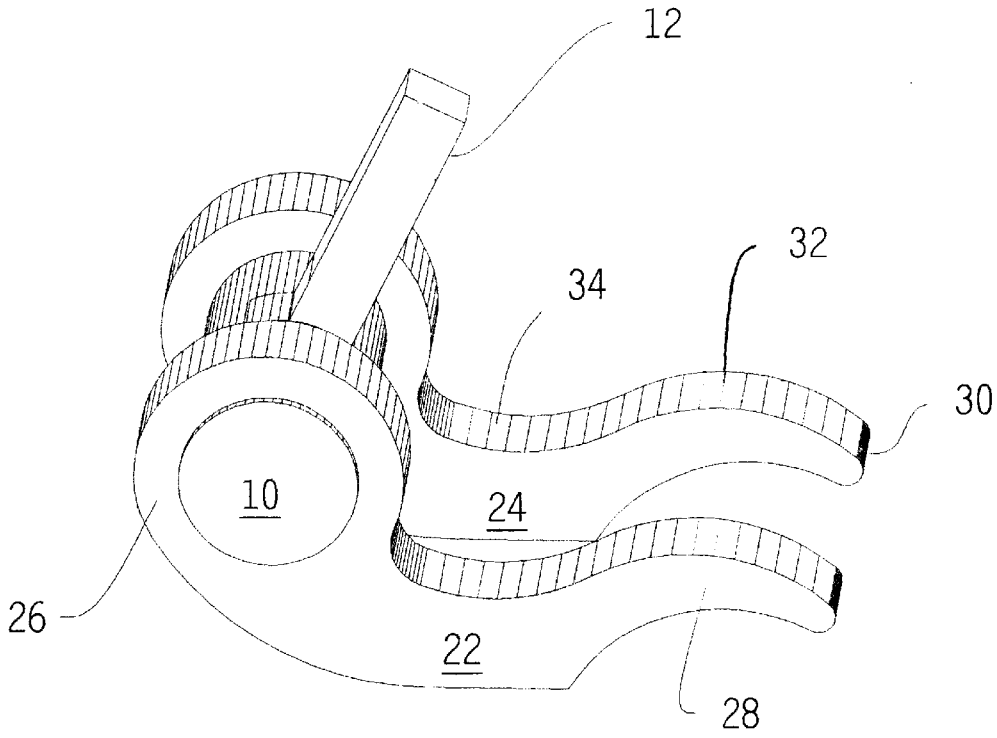
FIG. 1 is a perspective of a tool for removing deck boards embodying the invention, without its handle.
Figure 2:
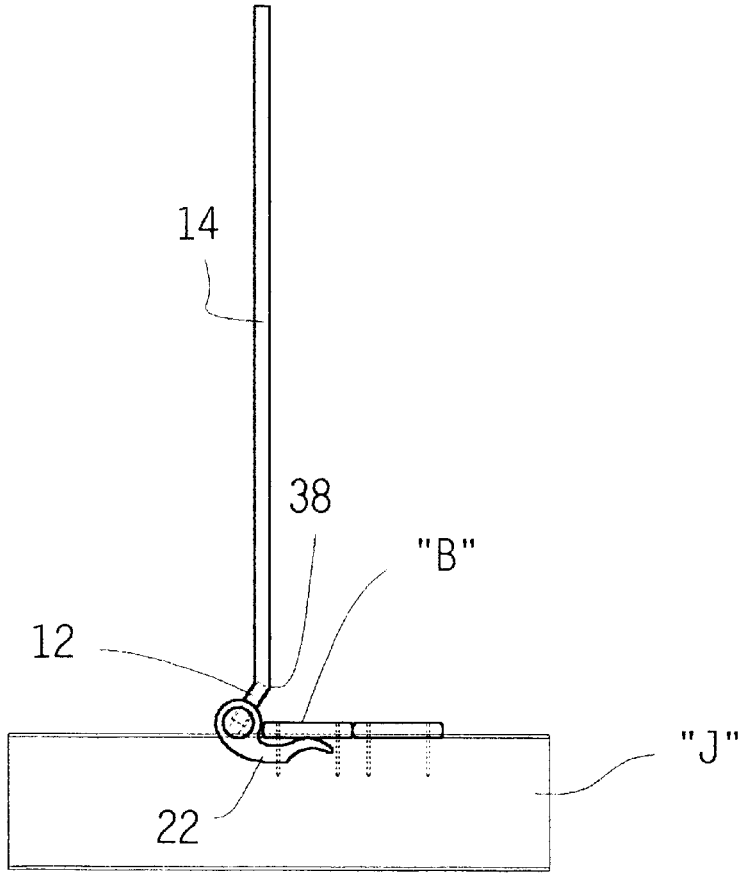
FIGS. 2 and 3 show the tool, with its handle in alternative positions.
Figure 3:
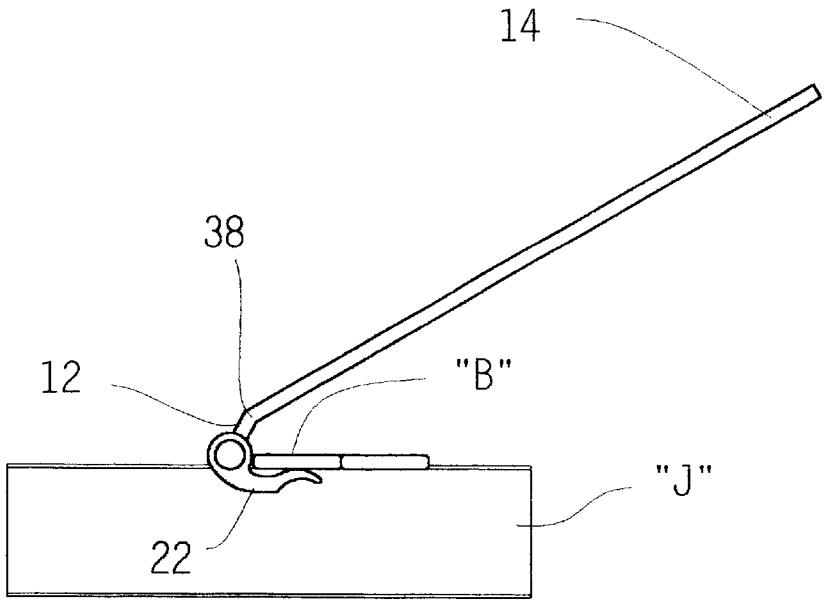
Figure 4:
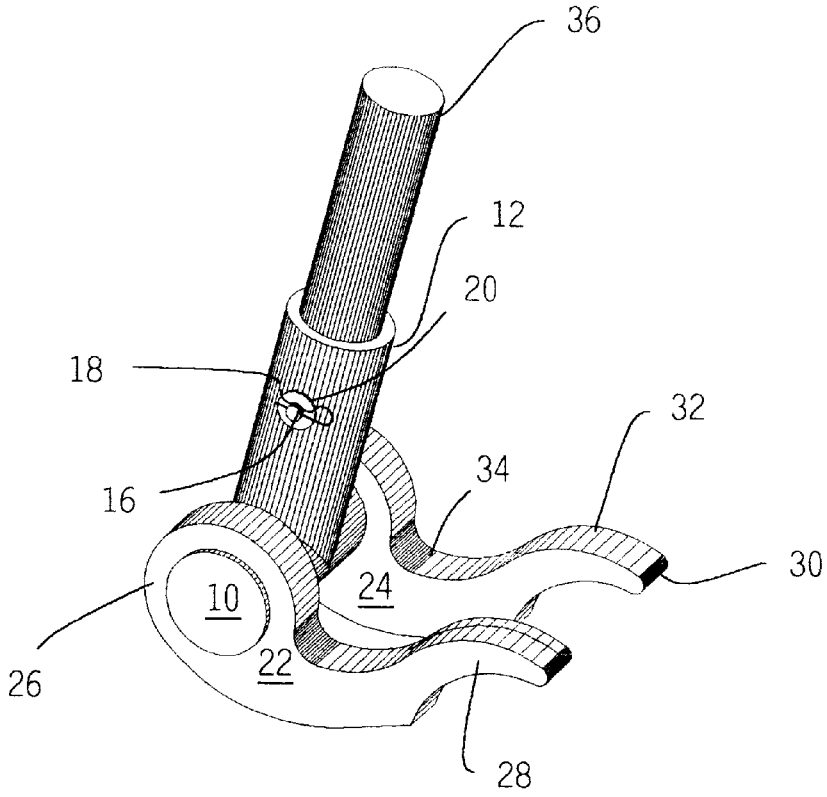
FIG. 4 is a view like FIG. 1, of an alternative form of the invention having a handle-receiving socket.

As seen in FIG. 1, a tool for removing deck boards includes an inverted tee-shaped base formed from a short robust shaft 10 with a tang 12 welded to the shaft at its center. The tang is sized to be received in a hole at the bottom of a handle 14 (FIGS. 2 and 3) and may have a square cross-section. Both the tang and the handle preferably have transverse through holes (not shown) for receiving a clevis pin 16, which is retained in place by a hairpin 18 bearing against a washer 20. The tang, which fits within the handle, may replaced by a socket (FIG. 4) into which the bottom end of a handle is inserted. As a further alternative, the handle and tang might be integrated into one part.

Figure 6:
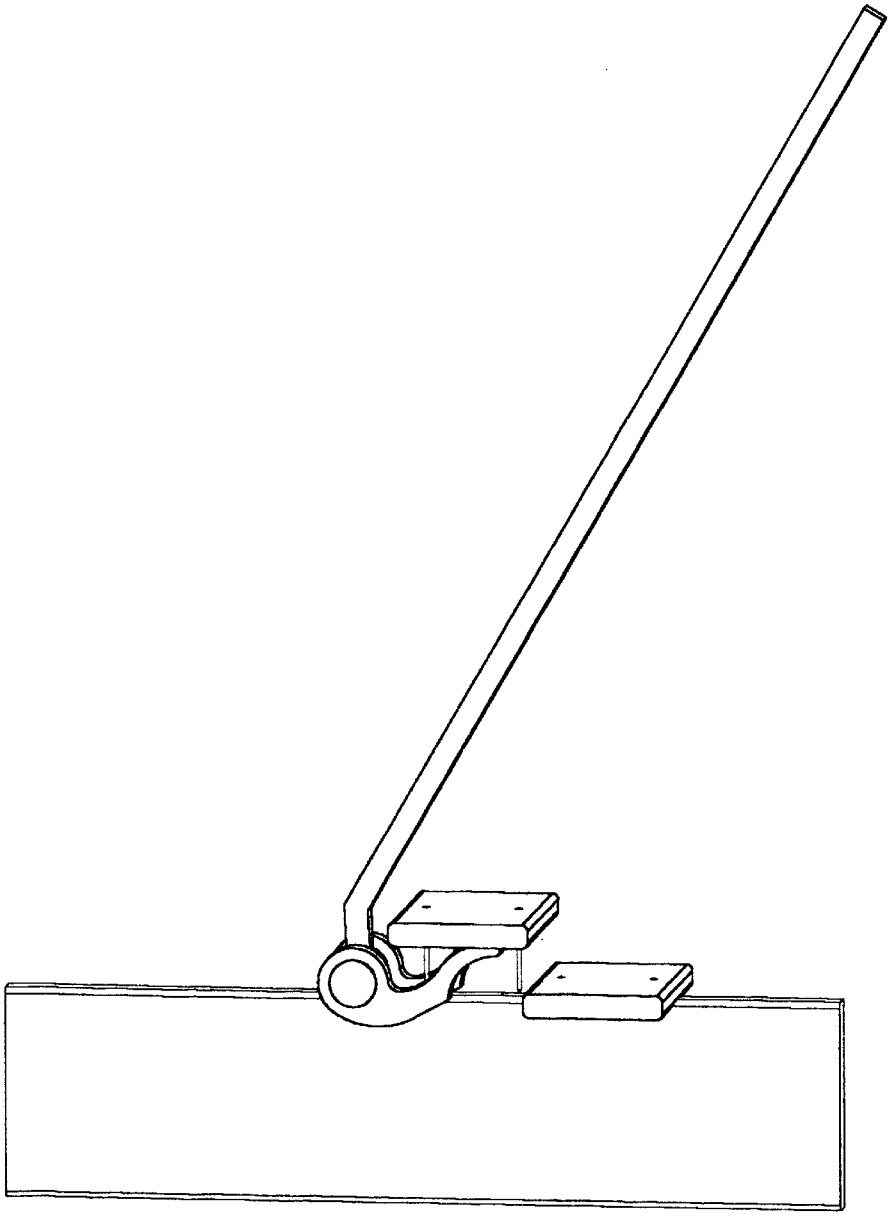
FIG. 6 is a view like FIG. 2, showing the board just free of the joist.
Figure 7:
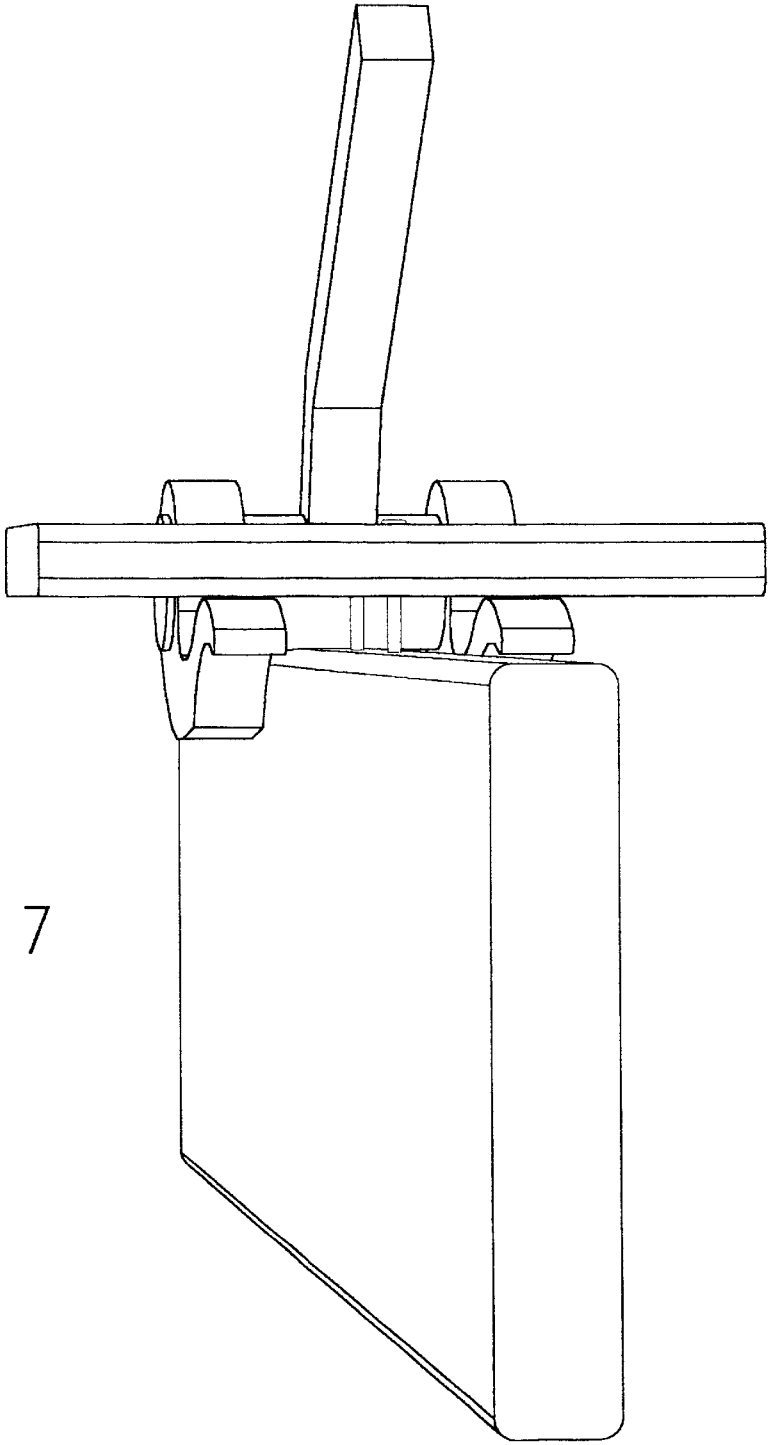
FIG. 7 shows the tool, looking along the joist.

Two prying arms 22, 24 are attached, for example by welding, to the opposite ends of the shaft 10, which preferably has a circular cross-section as illustrated, but could have a non-circular cross-section. The shaft length is such that there is a space of about three inches between the arms, i.e., room enough to accommodate a doubled joist. Each arm has a large end 26 with an eye shaped to receive the shaft, and a curved finger 28 that extends away from the large end. The finger is somewhat S-shaped, and terminates at a rounded tip 30. The upper, lifting surface of the portion 32 of the arm near the tip is convex, defined by a portion of a cylindrical surface. The radius of the cylindrical surface (about 2½ inches) is selected to maintain a contact point near the center of the board while the board is being removed, as one can see in FIGS. 5–7. The concave portion 34 of the upper surface of the arm provides clearance between the arm and the near bottom edge of the board, thus preventing lifting the board at its edge, to minimize board splitting and nail bending.

The handle 14 may be straight, but preferably, it has a bend 38 near its lower end. With a bent handle, one can change the angularity of the handle by (after removing the clevis pin) withdrawing the handle from the socket or tang, rotating it 180° and replacing it in on the tang. Compare FIGS. 2 and 3. With a bend of 28°, reversing the handle changes its effective angle by 56°. The handle geometry can be changed to suit the situation and the worker, enabling him at his option either to pull up or to push down on the handle to remove boards.

One or both of the prying arm tips may be provided with a wedge-shaped slot (not shown) so as to be useful for pulling nails from the boards once the boards have been removed from the deck.

Figure 5:
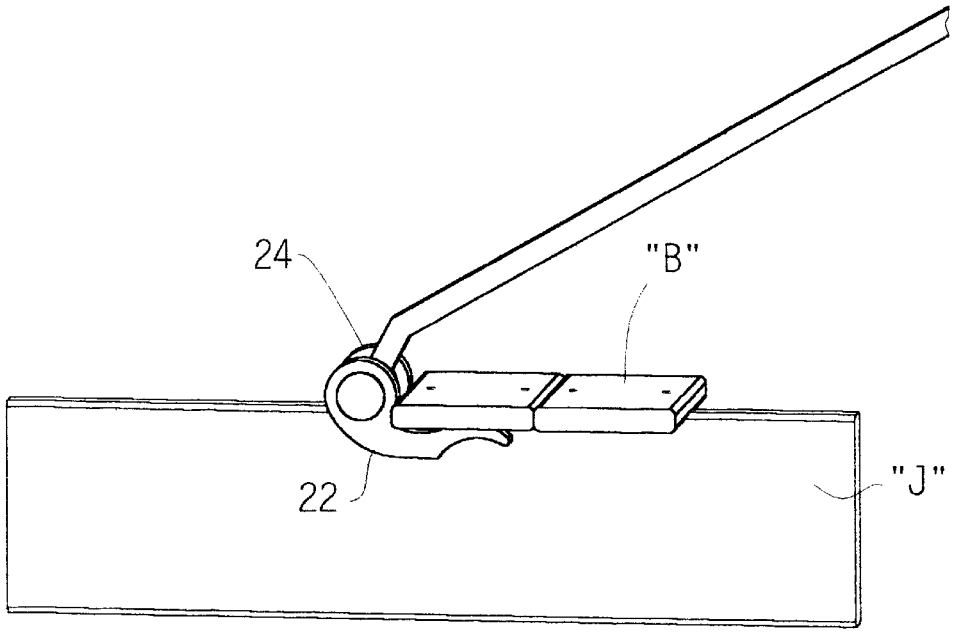
FIG. 5 shows the tool, having been placed on top of a joist, with its arms ready to pry off a board nailed to the joist.

As shown in FIG. 5, the prying arms are positioned under a deck board "B" to be removed, with the shaft 10 resting on the top of the joist "J", and the arms 22, 24 astride the joist. The handle is then pulled away from the board, causing the prying arms to lift the board (FIG. 6) on either side of the nails, at or near the centerline of the board. As the arms move upward, the shaft rolls along the top of the joist, away from the center line of the board. Simultaneously, the convex curvature of the lifting portion of the arms shifts the contact point further outward, maintaining a point of contact near the centerline, and delivering equal pulling forces to the nails at the edges of the board, so that the nails are drawn straight out, rather than being bent. The arms are designed with sufficient length to maintain contact between the convex lifting surfaces and the board until the nails are fully withdrawn. A board displacement of about 2½ inches is adequate in most cases. For six-inch wide boards, the arms should have a total length of about six inches.

The prying arm tip can be used to dislodge the first board (e.g., the board at the edge of the deck nearest the house). After the first board is out, the remaining boards are lifted swiftly, efficiently and safely. The entire deck may be removed without other tools. Because of the rounded rolling surface provided by the shaft, there is minimal damage to the top surfaces of the joists. Furthermore, the paired prying arms distribute lifting forces over a substantial area on the bottom of the boards, minimizing surface damage and board splitting.

The invention is not limited to the removal of deck boards. It may also be used to remove roof decking from rafters, wall boards from studs, or wherever boards are attached to supporting structures. The sizes and proportions given are those presently preferred; however, the invention is subject to variations and modifications. Therefore, the foregoing description and the accompanying drawings should be interpreted as only illustrative of the invention defined by the following claims.

I claim:

1. In a tool for removing deck boards from joists, said tool comprising a base member, a pair of spaced prying arms affixed to the base member, said arms being spaced from one another sufficiently to straddle a joist when the base member is placed on top of the joist, and a handle attached to the base member, the improvement wherein each of said arms has a convex lifting surface for engaging bottom surfaces of said boards, said convex lifting surface terminating at a rounded tip and having an extent sufficient to remain in contact with the board until the board has been completely separated from the joist.

2. The invention of claim 1, wherein the arms are spaced apart sufficiently to straddle doubled joists.

3. The invention of claim 1, wherein each said convex lifting surface is disposed to engage a deck board at or near a centerline of the board when the tool is adjacent one edge of the board, during removal of the board.

4. The invention of claim 1, wherein said convex lifting surfaces are substantially defined by a common cylindrical surface.

5. The invention of claim 4, wherein said cylindrical surface has a radius of about 2½ inches.

6. The invention of claim 1, wherein the handle has a bend therein, and further comprising means for retaining said handle to said base member at either of two orientations with respect to the base member, to provide alternative effective handle angles so that one can operate the handle from either side of a board being removed.

* * * * *